United States Patent [19]

Hartmann et al.

[11] Patent Number: 4,714,651

[45] Date of Patent: Dec. 22, 1987

[54] ELASTIC ROOFING AND SEALING MATERIALS

[75] Inventors: Ludwig Hartmann; Ivo Ruzek, both of Kaiserslautern, Fed. Rep. of Germany

[73] Assignee: Firma Carl Freudenberg, Weinheim/Bergstr., Fed. Rep. of Germany

[21] Appl. No.: 736,419

[22] Filed: May 20, 1985

Related U.S. Application Data

[63] Continuation of Ser. No. 537,855, Sep. 30, 1983, abandoned, which is a continuation of Ser. No. 343,110, Jan. 27, 1982, abandoned.

[30] Foreign Application Priority Data

Nov. 14, 1981 [DE] Fed. Rep. of Germany ..... 3145266

[51] Int. Cl.[4] ..... B32B 27/02

[52] U.S. Cl. ..... 428/286; 428/284; 428/288; 428/289; 428/291; 428/341; 428/485

[58] Field of Search ..... 428/291, 141, 284, 287, 428/289, 341, 288, 290, 286, 296, 489

[56] References Cited

U.S. PATENT DOCUMENTS 4,055,453 10/1977 Tajima et al. ..... 156/279
4,417,931 11/1983 Li ..... 428/288

FOREIGN PATENT DOCUMENTS 1019208 2/1966 United Kingdom .
1394997 5/1975 United Kingdom .

*Primary Examiner*—John E. Kittle
*Assistant Examiner*—P. R. Schwartz
*Attorney, Agent, or Firm*—Kenyon & Kenyon

[57] ABSTRACT

High-strength elastic roofing and sealing material consisting of at least one bonded fabric layer of organic material, optionally at least one further bonded fabric or bonded-fabric material layer of inorganic material, and a coating of bitumen on both sides, where the bonded fabric layer(s) is (are) impregnated with the bitumen, and where the bonded fabric of organic material has a certain area weight and a certain residual deformation after previous elongation. The bitumen coating optionally can be made elastic by the addition of modifiers with sufficiently low glass conversion points.

12 Claims, No Drawings

ELASTIC ROOFING AND SEALING MATERIALS

BACKGROUND OF THE INVENTION

This application is a continuation of application Ser. No. 537,855, filed Sept. 30, 1983, now abandoned, which in turn is a continuation of Ser. No. 343,110, filed Jan. 27, 1982, now abandoned.

The present invention relates to a very strong elastic roofing substrate and sealing material consisting of at least one bonded fabric layer of organic material, optionally at least one further fabric or bonded-fabric layer of inorganic material, and a bitumen coating on both sides, the bonded fabric material layer(s) being saturated with the bitumen.

The sealing of surfaces (for example, roofs) with bituminous substrates is known. The bituminous substrate customarily consists of a carrier which is saturated and/or coated with bitumen. Fabrics, bonded-fabric materials or felts of textile wastes, for instance, wool, are often used as carrier materials. However, such carriers have only little strength and nearly no elasticity.

For coating the known bituminous substrates so-called oxidized bitumen is used, the visco-elastic behavior of which is highly temperature-dependent. Thus, oxidized bitumen readily flows at higher temperatures, is permanently deformed in the medium temperature range and becomes brittle and fragile at lower temperatures around the freezing point.

Conventional roof designs using bituminous roofings which are intended to be reasonably tight, contain as a rule several (and often even more than five) layers of the above-described simple roofing materials. Even so, damage due to lack of elasticity of the roofing material and dilatation movements of the roof structure frequently is observed. In addition, the installation costs are very high because it is necessary to stack many courses of the sealing tape on top of each other. Roofing work at low temperatures is nearly impossible because of the embrittlement of the roofing tape.

It has been proposed to improve the quality of the bituminous roofing material through the use as carriers of glass or mineral fiber-bonded or woven fabrics, optionally together with organic synthetic fibers. Such a proposal is described in DE-GM No. 77 23 547. While these carrier materials have substantially higher strength than originally used roofing papers, their elongation at break is very low and usually is about 2 to 5%. The dimensional changes caused by dilatation lead as a rule to cracks because of the lack of elasticity and a low capacity to accommodate working.

A further improvement of the bituminous roofing material was attempted through the introduction of modifiers which were supposed to improve the visco-elastic behavior of the bitumen. Thus, a mixture of bitumen and ethylene copolymer is proposed in DE-GM No. 79 05 531. In this manner, the visco-elastic behavior of the bitumen and in particular its high temperature dependence can be improved, so that such roofing materials can be handled even at low temperatures. However, an improvement of the bitumen elasticity alone is not sufficient for improving the sealing function of bituminous roofing material per se because the elasticity of the sealing material is substantially determined and limited by the properties of the textile or mineral carrier material. Neither the conventional papers made of various waste fibers nor those optionally containing very strong carrier materials like glass, bonded or woven fabrics have the required temperature-independent elasticity. As a result, cracks and leaks can again occur on the roof due to thermal dilatation.

SUMMARY OF THE INVENTION

It is accordingly an object of the present invention to provide improved bituminous roofing materials which can be installed without complications in a large temperature range and which are resistant to cracking or leaking even after long storage periods.

This and other objects are achieved by the provision of a bituminous roofing material comprised of at least one bonded-fabric carrier layer of organic material having a bitumen coating on both sides thereof such that the fabric layers are impregnated with the bitumen, wherein the bonded layer of organic material possess the following characteristics:

(a) an area weight of 50 to 350 g/m$^2$; and (b) a permanent residual deformation after relaxation $\epsilon_\infty$, in the temperature range of between $-20°$ C. and $+70°$ C. in the range of a forced deformation (elongation) caused by a stress $\epsilon_s$ of 0.03 to 0.30%, the value of which is given by:

$$\epsilon_\infty \leqq 29.6226 \cdot \epsilon_s^3 - 15.5418 \cdot \epsilon_s^2 + 2.9359 \cdot \epsilon_s - 0.0769.$$

The bonded-fabric layer(s) may optionally have at least one further bonded fabric (or bonded-fabric material) layer of inorganic material. Additionally, the bitumen coating may optionally have added to it modifiers which render it more elastic, for example, plastomers having sufficiently low glass conversion points.

In connection with the present invention it was found that a particularly advantageous improvement of known bituminous roofing materials is directed toward the use of webs or rolls of bonded fabric according to the invention, which are specifically intended to correct the known shortcomings of known roofing materials as to elasticity.

It is particularly advantageous to use these webs of bonded fabric in combination with elastic-modified types of bitumen. Modifiers for the bitumen can include plastomers having sufficiently low glass conversion points, for example, atactic polypropylene and particularly thermoplastic elastomers with a styrene-butadiene block copolymer base (SBR). Through combination of rigid styrene and elastic butadiene blocks, these last-mentioned elastomers form a physically held-together network and exhibit good elasticity nearly independent of possible temperature changes up to the glass conversion point of polystyrene. Through the admixture of suitable modifiers, particularly of elastomer block copolymers, the viscoelastic behavior of the bitumen, and particularly its high temperature independence, can be permanently improved. Roofing materials made with such bitumen compounds can be handled without complications also at low temperatures.

It is possible to make the elastic roofing and sealing materials relatively thin, thicknesses of 2 to 8 mm being sufficient as a rule. It is essential that the surface is always formed by a sufficiently strong and compact bitumen layer. It is furthermore advantageous that the elastic fiber-reinforced roof sealing material has a graduated composition over its cross section. This is understood to mean that the reinforcing-fiber content for the cover web increases inward. The surface is, therefore, substantially free of fibers while the fiber density increases progressively toward the inside.

Regardless of the design of the roofing or sealing material, i.e., of the use of one or several bonded-fabric layers which consist of hydrophobic synthetic fibers and, optionally, of the additional use of one or several bonded-fabric layers of inorganic material, it is essential for the invention that the bonded fabric carrier has so high an elasticity that it has a permanent residual deformation $\epsilon_\infty$ in the temperature interval between −20° C. and +70° C. and in the range of a forced deformation, caused by stress $\epsilon_s$ of 0.03 to 0.30 after the cessation of the stress and the relaxation caused thereby, the value of which is at most $$\epsilon_\infty \leqq 29.6226 \cdot \epsilon_s^3 - 15.5418 \cdot \epsilon_s^2 + 2.9359 \cdot \epsilon_s - 0.0769.$$

The optimum residual deformation of the bonded fabric carriers can be determined in each case by suitable simple tests.

The values of the residual deformation required in the temperature range between −20° C. and +70° C. are of importance particularly for the continuous stress of the roofing and sealing material. Surprisingly, the properties of the completed course of roofing in use can be measured in this manner simply by analysis and definition of the carrier material.

While in principle the roofing and sealing material according to the present invention can be produced using normal bitumen mixtures, it is advisable in many cases to use elastic-modified bitumen mixtures. Even in this case, however, the elastic behavior of the roofing material is determined exclusively by the above-defined elastic properties of the carrier material.

A particularly advantageous embodiment of the roofing and sealing material consists of the use of a carrier of largely hydrophobic synthetic-fiber fabrics. The weight per square meter of the fabric is between 50 and 350 g/m$^2$, depending upon the application. Because of the type of stress occuring on the roof, it is necessary that the bonded fabric materials used as the carrier have no preferred geometric direction with repect to their properties. For example, a two-dimensional distribution of the strength properties such as is found in woven fabrics is very disadvantageous.

The bonded fabric carrier or insert for the bituminous roofing and sealing material has still further important properties besides the described high elasticity. The maximum tensile strength, measured according to DIN No. 58 857 on strips 5 cm wide, is at least 250N, converted to an area weight of 100 g/m$^2$. The maximum tensile elongation is between about 30 and 60%.

The web of bonded fabric material used as the carrier is advantageously bonded by smooth or structured calender rolls. A preferred embodiment consists of a material bonded in two stages, where it is first pre-bonded by means of a heated calender and then finally bonded with a bonding agent dispersion. In a particular embodiment, the bonded fabric of organic material contains a mixture of fibers such that it contains up to 25% by weight thermoplastic bonding fibers for bonding the fabric.

The fibers of the bonded fabric are largely hydrophobic synthetic fibers, particularly polyester fibers. Particularly advantageous are spun-bonded fabrics of polyester fibers.

For some purposes it is desirable to use bituminous roofing or sealing materials which contain, in addition to the textile bonded fabrics, less elastic carriers, for example, spun-glass fabrics or woven glass fabrics. Here, the elastic carrier web of textile bonded fabric serves as safety if, because the elastic limit of the less elastic inorganic bonded fabric is exceeded, the roofing and sealing tape would break unless the textile carrier material is also used. The use of the less elastic carrier, however, due to its high initial modulus, particularly at high temperatures of 180° to 200° C., ensures good workability during the coating in the bitumen bath even if a very light elastic carrier is used for economic reasons.

The roofing and sealing materials or rolls proposed according to the invention can be produced by several methods. The immersion method, in which the carrier material is dipped in a heated bitumen bath and is coated in this manner has been proven practical. The roofing material also can be produced, however, by a calender coating method, where the bitumen layer is formed in a calender gap and is laminated to the carrier.

The required elasticity is measured following the strength tests for textiles according to DIN 58 857. Strips 5 cm wide are used as test specimens, and the clamping length is 20 cm. In the tests for elasticity, the specimen is stretched by an amount of, for example, 10%, 20%, or 30% by applying the tension required therefor. The tension then is removed so that the specimen can relax freely.

After 10 minutes, the remaining length of the specimen is determined. The forced deformation and the residual deformation are defined here as follows:

$$\epsilon_s = \frac{L_s - L_o}{L_o} = \frac{\Delta L_s}{L_o}$$

$$\epsilon_\infty = \frac{L_\infty - L_o}{L_o} = \frac{\Delta L_\infty}{L_o}$$

where, $L_o$ is the initial length of the specimen (clamping length)

$L_s$ the length of the specimen under tension, and $L_\infty$ the length of the specimen after relaxation.

DETAILED DESCRIPTION OF THE INVENTION

The present invention is described in further detail with the aid of the following example.

EXAMPLE

A spun-bonded polyester fabric was formed by spinning polyethylene terephthalate into endless filaments which were drawn off in an air jet by means of an aerodynamic drawing device and the filaments were simultaneously draw-oriented in the process and distributed by an oscillating motion. The area weight of the fabric was 220 g/m$^2$. This spun-bonded fabric was pre-bonded in the gap of a calender with smooth rolls, heated to 140° C., so that it formed a layer 0.55 mm thick. In a (Foulard) padding machine, this fabric was impregnated with a dispersion of a bonding agent which consisted of a co-polymer dispersion of styrene, acrylic acid, acrylonitrile, acrylamide and butylacrylate. The impregnated fabric was dried and post-condensed at temperatures of 200° C. The finished fabric material had the following properties:

Area weight: 250 g/m$^2$
Thickness: 0.55 mm
Maximum tension,
lengthwise: 880N crosswise: 830N Maximum tensile elongation, lengthwise: 56% crosswise: 55%

The elasticity of the material was tested, as described above, at the following temperatures: −20° C., +20° C., and +70° C. The results are given in Table 1.

TABLE 1

| Test | Forced Deformation | Temperature | Residual Deformation |
|---|---|---|---|
| 1 | 0.15 | −20° C. | 0.0645 |
| 2 | 0.15 | +20 | 0.0605 |
| 3 | 0.15 | +70 | 0.0610 |
| 4 | 0.20 | −20 | 0.096 |
| 5 | 0.20 | +20 | 0.100 |
| 6 | 0.20 | +70 | 0.090 |
| 7 | 0.30 | −20 | 0.186 |
| 8 | 0.30 | +20 | 0.180 |
| 9 | 0.30 | +70 | 0.156 |

The following maximum values apply, from the equation $$\epsilon\infty \leqq 29.6226\cdot\epsilon_s^3 - 15.5418\cdot\epsilon_s^2 + 2.9359\cdot\epsilon_s - 0.0769$$

for the tested values of the forced deformation:

For $\epsilon_s = 0.15$: $\epsilon\infty \leqq 0.1138$ $\epsilon_s = 0.20$: $\epsilon\infty \leqq 0.1256$ $\epsilon_s = 0.30$: $\epsilon\infty \leqq 0.2049$

What is claimed is:

1. A high strength elastic roofing and sealing material comprising at least one nonwoven bonded organic fabric carrier layer comprising up to about 25% of thermoplastic bonding fibers, said carrier layer being bonded through the use of thermal calendering followed by the application of a copolymer dispersion, said bonded carrier layer having a coating of bitumen on both sides thereof such that the carrier layer is impregnated with bitumen, wherein the carrier layer possesses the following characteristics:

(a) an area weight of from about 50–350 g/m², and;

(b) a permanent residual deformation after relaxation $\epsilon\infty$, in the temperature range of between −20° C. to +70° C. in the range of a forced deformation elongation caused by a stress $\epsilon_s$ of 0.03% to 0.30%, the value of which is given by:

$$\epsilon\infty \leqq 29.6226\cdot\epsilon_s^3 - 15.5418\cdot\epsilon_s^2 + 2.9359\cdot\epsilon_s - 0.0769.$$

2. The roofing and sealing material according to claim 1 comprising at least one additional bonded fabric or fabric-bonded material layer of inorganic material arranged in contact with the bonded fabric layers of organic material.

3. The roofing and sealing material according to claim 2 wherein said bonded fabric of inorganic material contains fibers selected from the group consisting of glass, asbestos, mineral fibers and mixtures thereof.

4. The roofing and sealing material according to claim 1 wherein said bitumen coating comprises bitumen to which has been added one or more modifiers to render said bitumen more elastic, said modifiers comprising a plastomer having a low glass transition point.

5. The roofing and sealing material according to claim 1 wherein several bonded fabric layers of organic material are employed, and wherein the thermoplastic bonding fiber content is distributed in the cross-section of several layers in a manner such that the surface thereof is substantially-free of said bonding fibers, the bonding fiber density increasing progressively below said surface.

6. The roofing and sealing material according to claim 1 wherein said fabric of organic material consists of a substantially hydrophobic bonded fabric of synthetic fibers.

7. The roofing and sealing material according to claim 6 wherein said fabric of organic material is a spun-bonded fabric of polyester fibers.

8. A high-strength elastic roofing and sealing material comprising at least one spun-bonded organic fabric carrier layer, said carrier layer being bonded through the use of thermal calendering followed by the application of a bonding agent dispersion, said bonded carrier layer having a coating of bitumen on both sides thereof such that the fabric layers are impregnated with the bitumen, wherein the carrier layer of organic material possesses the following characteristics:

(a) an area weight of from about 50 to 350 g/m²;

(b) a permanent residual deformation after relaxation $\epsilon\infty$, in the temperature range of between −20° C. to +70° C. in the range of a forced deformation elongation caused by a stress $\epsilon_s$ of 0.03% to 0.30%, the value of which is given by:

$$\epsilon\infty \leqq 29.6226\cdot\epsilon_s^3 - 15.5418\cdot\epsilon_s^2 + 2.9359\cdot\epsilon_s - 0.0769;$$

and (c) a maximum tensile elongation between 30% and 60% for a specific maximum tension according to DIN No. 58 857, measured on strips 5 cm wide, and a maximum tensile strength of at least 250N per 100 g/m² area weight.

9. The roofing and sealing material according to claim 8 wherein said bonded fabric of organic material has substantially the same maximum tensile strength and tensile elongation in all geometric directions.

10. A high strength elastic roofing and sealing material comprising at least one non-woven bonded organic fabric carrier layer comprising up to about 25% of thermoplastic bonding fibers, said carrier layer being bonded through the use of calendering followed by the application of a copolymer dispersion, said bonded carrier layer having a coating of bitumen on both sides thereof such that the carrier layer is impregnated with bitumen, wherein the carrier layer possesses the following characteristics:

(a) an area weight of from about 50–350 g/m²; and, (b) a permanent residual deformation after relaxation $\epsilon\infty$, in the temperature range of between −20° C. to +70° C. in the range of a forced deformation elongation caused by a stress $\epsilon_s$ of 0.03% to 0.30%, the value of which is given by:

$$\epsilon \leqq 29,6226\cdot\epsilon_s^3 - 15.5418\cdot\epsilon_s^2 + 2.9359\cdot\epsilon_s - 0.0769$$

and further comprising a second carrier layer of an inorganic fabric having a lower elastic limit than and in contact with the bonded fabric carrier layer.

11. The roofing and sealing material recited in claim 10, wherein: the inorganic bonded fabric is spun glass.

12. The roofing and sealing material recited in claim 10 wherein: the inorganic bonded fabric is woven glass.

* * * * *